United States Patent [19]

Forterre et al.

[11] Patent Number: 4,733,202

[45] Date of Patent: Mar. 22, 1988

[54] COUPLING DEVICE BETWEEN AN ELECTROMAGNETIC SURFACE WAVE LINE AND AN EXTERNAL MICROSTRIP LINE

[75] Inventors: Gérard Forterre, Colombes; Julien Prevot, Osny, both of France

[73] Assignee: Thomson-CSF, Paris, France

[21] Appl. No.: 921,426

[22] Filed: Oct. 22, 1986

[30] Foreign Application Priority Data

Oct. 25, 1985 [FR] France ..... 85 15880

[51] Int. Cl.[4] ..... H01P 5/10

[52] U.S. Cl. ..... 333/26; 333/33; 333/260

[58] Field of Search ..... 333/1.1, 24.1, 24.2, 333/33, 34, 240, 260, 26

[56] References Cited

U.S. PATENT DOCUMENTS 3,617,951 11/1971 Anderson .
3,662,318 5/1972 Decuyper .
3,845,413 10/1974 Chiron et al. ..... 333/1.1
3,886,502 5/1975 Radding et al. .

OTHER PUBLICATIONS

Patents Abstracts of Japan, vol. 4, No. 145 (E-29) [627], 14 Oct. 1980; & JP-A-55 97 702 (Mitsubishi Denki K.K.)

*Primary Examiner*—Paul Gensler
*Attorney, Agent, or Firm*—Oblon, Fisher, Spivak, McClelland & Maier

[57] ABSTRACT

A device for coupling between an electromagnetic surface wave device (OSEL), operating in a symmetrical field distribution mode and an external microstrip line operating in a disymmetric mode. Coupling between the access microstrip to the surface wave device and the external microstrip is provided by means of three line elements made from dielectric materials, held in position by three non magnetic metal parts, forming a transition between symmetric and disymmetric modes in steps:

electromagnetic surface wave mode, a symmetric mode of the surface wave device,
three plate mode,
microstrip mode with reactance matching,
disymmetric microstrip mode of the external microstrip line.

16 Claims, 6 Drawing Figures

COUPLING DEVICE BETWEEN AN ELECTROMAGNETIC SURFACE WAVE LINE AND AN EXTERNAL MICROSTRIP LINE

BACKGROUND OF THE INVENTION

The present invention relates to a coupling device between a surface wave line and a microstrip line. More precisely it relates to a coupling device between a microstrip line, in which the field distribution is asymmetric, operating in quasi-TEM mode, and an access line to a device, such as an isolator or a non-reciprocal ferrite device, in which the field distribution is symmetric, using an electromagnetic surface mode propagating in a thin core line, charged with ferrite pieces, and biased by a magnetostatic field.

An object of the invention is to make this non reciprocal device integrable, and to omit the coaxial connectors which were used up to present, because they are too bulky for integration.

A known technique, giving satisfactory results but difficult to put into practice and so practically unusable consists in integrating, in the two access lines to the surface wave device, a coaxial line element in the form of a glass bead matched to 50 ohms, which is tantamount to reconstituting the system for exciting the electromagnetic surface wave mode used in known devices. However, this glass bead introduces parasitic elements disturbing the matching of the device.

Furthermore, experience has shown that direct connection of a microstrip line to the thin core line of a symmetrical surface wave device does not give good results, the insertion losses being too high.

SUMMARY OF THE INVENTION

The matching system or coupling device of the invention consists in using, for the transition between the thin core and the microstrip line, several line elements of small length and having transverse dimensions which are small with respect to the wave length, these elements being of different types and structures so as to obtain a progressive symmetry-disymmetry transition, in steps, the element the closest to the thin core being necessarily symmetric and of small transverse dimensions so as to impose a symmetrical field structure at the level of the access to the thin core line.

The symmetry-disymmetry transition thus takes place in four steps, representing four modes:

electromagnetic surface wave mode of the thin core,
three plate mode,
microstrip line plus reactance mode, and
disymmetric mode of the external microstrip line.

More precisely the invention provides a coupling device between a symmetric electromagnetic surface wave line and an external microstrip line, the surface wave line, ending in at least one microstrip access line, functioning in a symmetrical field distribution mode whereas the external microstrip line functions in a disymmetric field distribution mode, this coupling device including a plurality of line elements of small lengths and with transverse dimensions which are small with respect to the wave length of the signal, the nature and structure of these line elements providing progressive transition between the symmetric and disymmetric modes in four steps:

electromagnetic surface wave mode, a symmetrical mode of the surface wave line, three plate mode,
microstrip mode with two different dielectrics,
air microstrip mode, disymmetric mode of the external microstrip line.

BRIEF DESCRIPTION FO THE DRAWINGS

The invention will be better understood from the following description of one embodiment, this example being based, so as to be more precise in the description, on the case of a so called OSEL insulator (electromagnetic surface waves), as well as on the accompanying Figures which show:

FIG. 1: a sectional view of a known OSEL isolator,

FIG. 2: a plan view of a known OSEL isolator,

FIG. 3: a sectional view of a device for coupling a microstrip line to an OSEL isolator, in accordance with the invention, FIG. 4: a plan view of a device for coupling the microstrip line to an OSEL isolator, in accordance with the invention, and FIGS. 5 and 6: plan and sectional views of the two parts which provide the three plate mode transition, in the coupling device of the invention.

DESCRIPTION OF THE PREFERRED EMBODIMENTS

The fact of choosing a non reciprocal device such as an OSEL isolator for describing the invention does not limit the scope of the invention which applies more generally to electromagnetic surface wave devices, and to transitions between symmetrical and asymmetrical field distribution modes. However, the previous description of an OSEL isolator will help in understanding the description of the coupling device of the invention.

Figure 1:
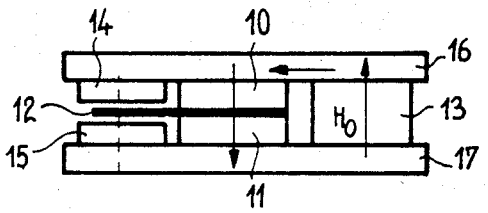
FIG 1 PRIOR ART
Figure 2:
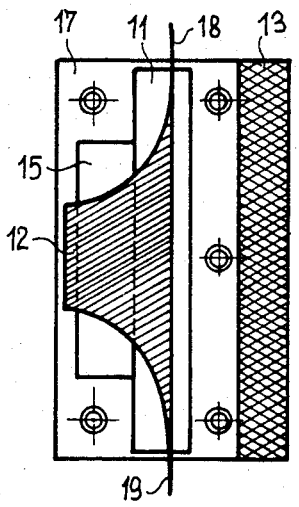
FIG 2 PRIOR ART

An electromagnetic surface wave isolator OSEL is formed in accordance with the diagrams of FIG. 1 and FIG. 2 which are to be considered simultaneously. This type of isolator is essentially formed, except for its connection elements, by:

two thin ferrite plates 10 and 11,
a very thin central core with special profile 12, placed between the ferrite plates 10 and 11,
a magnet 13,
absorbant material plates 14 and 15, situated on each side of the core 12,
two rigid platens 16 and 17 made from soft steel, serving simultaneously as ground planes (silver coating) and as yokes for closing the magnetic circuit (shown by arrows).

The assembly of these parts is clamped together between the two yokes 16 and 17 by meahs of screws whose holes appear in FIG. 2. In this Figure, yoke 16 as well as the ferrite plate 10 and the absorbant plate 14 have been omitted so as to show the internal structure of the isolator and the particular shape of the thin central core 12, which ends in two microstrips 18 and 19 for external access through a coaxial connector, a 50 ohm matched glass bead or a coupling device in accordance with the invention.

When the ferrites are biased by a magnetostatic field $H_O$ normal to the platens, this type of structure supports type $TE_{mo}$ modes of a particular kind, for it may be admitted that they are guided or confined between two "magnetic walls" defined by the surfaces parallel to $H_O$ and bearing on the edges of the central wall 12.

For optimum operation, the very wide band oscillators and receivers imperatively require good matching, at least in their nominal operating band, and for most of them, within a certain range thereabout, so as to avoid reaction coupling or parasitic oscillation.

The electromagnetic surface wave isolating devices OSEL are the best devices adapted to non reciprocal wide band ferrite devices. With respect to the only type of Y junction isolator which can at present be constructed (two ferrite structure), they have the following advantages:

- much better matching maximum standing wave ratio 1.25 (against 1.5 fo Y junctions) in the pass band and stable in phase:
- matching substantially maintained in the rest of the band, whereas a Y junction behaves like a band pass filter,
- isolator better than 18 dB against 14 dB for Y junctions.

The use of this type of isolator in the new ultrahigh frequency systems using very flat amplifiers may be considered to the extent that an integrable transition is provided between the OSEL mode, of type $TE_{OO}$ and the non symmetrical quasi TEM mode of the microstrip lines.

The problem raised by connecting an OSEL isolator to a microstrip type line comes then from the disymmetric nature of the mode propagated over the microstrip lines.

The coupling device of the invention has the merit of remaining continuous all along the flat structure conducting cores, as well as of reducing to their lowest expression the parasitic elements due to the discontinuities between the central core 12 and an external microstrip 9.

Figure 3:
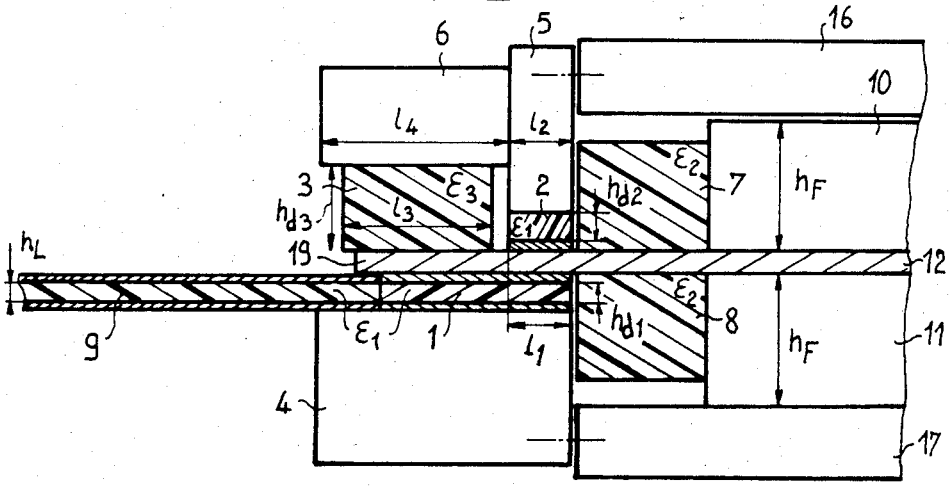
Figure 4:
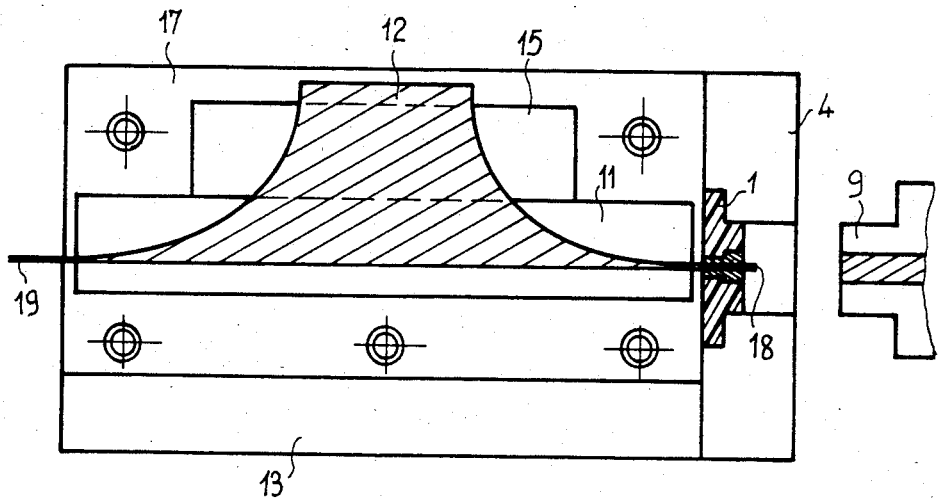

This coupling device of the invention is shown in section in FIG. 3, whereas FIG. 4 shows it in a plan view mounted on an OSEL isolator and allows the design to be better understood.

What is described in connection with one end 19 of the isolator is of course valid for the other end 18.

The references, which have been kept, allow the components of the OSEL isolator of FIGS. 1 and 2 to be found again in FIGS. 3 and 4.

In FIG. 3—on the right of the Figure—is shown a fragment of the OSEL isolator, comprising a thin core 12, clamped between two thin ferrite plates 10 and 11, themselves clamped between two steel platens 16 and 17. The thickness of each of the platens 16 and 17 is sufficient for it to be possible to form a tapped hole longitudinally therein for fixing the coupling device. The end 19 of the central core 12 projects from the isolator over a length of the order of 2.5 to 3 mm: it is from this end 19 that contact with an external microstrip 9 will be taken. The isolator further includes, in a way known per se, two pieces 7 and 8, placed between the ferrite plates 10–11 and the coupling device: these pieces 7 and 8 are made from a dielectric material with constant $\epsilon_2$ and serve for matching the OSEL isolator.

The coupling device properly speaking includes three parts referenced 1, 2 and 3 and their respective mechanical supports 4, 5 and 6.

Part 1 is a dielectric material piece of polytetrafluoroethylene type charged with glass fibers, such as known under the name of RT Duroid, but it may also for example be made from a ceramic such as alumina or beryllium oxide. Its permittivity $\epsilon_1$ is the same as that of the support of the external microstrip part 9 and as that of part 2 which will be described hereafter.

This part 1 has a T shape (see FIG. 5) and it is metallized on both its main faces so as to provide a ground plane 21 on one face and, after etching, a metallization 20 on the other face. The cross leg 22 of the T has a length $L_1$, a width $l_1$ and a dielectric thickness $h_{d1}$. Part 1 is applied to the OSEL isolator by its cross leg 22 and the end 19 of the central core 12 rests on the metallization 20.

Figure 5:
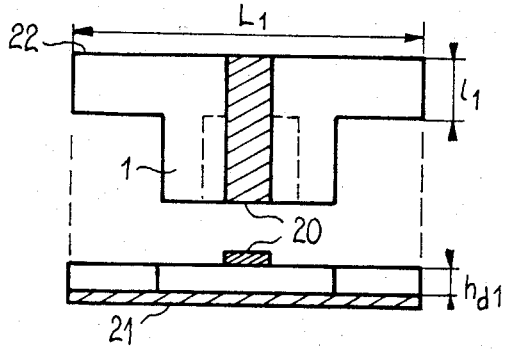

In a variant, shown by a broken line contour in FIG. 5, the etched metal track 20 may have a widened part. This widened part participates, with the dielectric part 3, in the matching in the transition between the symmetric and asymmetric modes.

Figure 6:
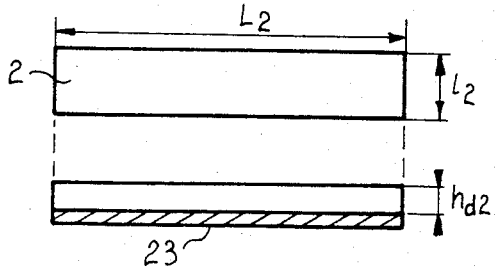

Part 2 is a tongue of dielectric material which has (see FIG. 6):

- the same permittivity $\epsilon_1$,
- the same length $L_2$,
- the same width $l_2$,
- the same dielectric thickness $h_{d2}$
- the same shape as the cross leg 22 of part 1, but it is metallized on only one main face, at 23. Part 2 is applied to the OSEL isolator by its longest side, so that it corresponds to the cross leg 22 of part 1. But part 2 is laid over the end 19 of the central core 12, the metallization 23 being in contact with said end 19.

Part 3 is a parallelepiped made of a dielectric material with permittivity $\epsilon_3$, whose dielectric thickness is $h_{d3}$ and width $l_3$, measured along the common axis to the end 19 of core 12 and to the external microstrip 9. The dimensions of part 3 are such that, when it is laid on the end 19 of core 12, which forms a microstrip, it projects from this microstrip so as to provide matching between the two microstrips 19 and 9. It is made from polytetrafluoroethylene or a ceramic such as alumina.

The assembly of these three dielectric material parts 1, 2 and 3 is held mechanically in position by three other non magnetic metallic pieces, respectively 4, 5 and 6. These are for example made from brass or silvered beryllium bronze of grade UBe2.

Part 4 forms the support for the coupling device of the invention. It is integral with the isolator, or more exactly with a platen 17, and it provides correct fitting thereof on a ground plane. This support 4 supports the dielectric material part 1, itself in contact with its etched metal track 20 with a first face of the microstrip 19 of the central core 12.

Part 5 is, like the support 4, integral with the isolator and more exactly with platen 16. This pressure piece 5 holds the dielectric material part 2 in position and presses it against the second face of the microstrip 19 of the central core 12, the metallization 23 of part 2 being in contact with said microstrip 19.

Support 4 and the pressure piece 5 both have a housing for positioning the two dielectric parts 1 and 2 and prevents lateral sliding thereof with respect to the microstrip line 19

Part 6 is a stirrup, integral with support 4: it holds the dielectric block 3 against the microstrip 19 and participates in matching of the coupling device.

The dimensions of the dielectric and metal pieces, particularly of support 4, with respect to the microstrip 19, are such that they allow the end of an external microstrip 9 to be inserted in the housing provided in support 4 for part 1. The microstrip 9 comprises a substrate, of permittivity $\epsilon_1$, a ground plane metallization on a main face of the substrate and the metal track of the microstrip 9 on the other main face of the substrate: it is in the form of a tongue.

This external microstrip line 9 rests—when it is in position—by its ground plane on support 4; it abuts against the dielectric part 1 and the microstrip line properly speaking is in contact with the end 19 of the central core 12. The dielectric block 3 and stirrup 6 press the end 19 of the central core 12 against the microstrip 9. To provide good electric contact, end 19 is bonded to the microstrip 9 by means of a conducting bonding agent.

In a variant, end 19 may slide over the microstrip 9 during large temperature variations.

The nature ($\epsilon_3$) of block 3, and the dimensions of block 3 ($l_3$) and of the stirrup 6 ($L_4$), measured along the axis of the microstrip line 19 allow the discontinuity reactances to be compensated for by adjustment.

FIG. 4 completes FIG. 3 by showing, in a top view, an isolator having a coupling device of the invention, as well as an external microstrip line at the point to be connected to the coupler. So as to better see the structure of the whole, the isolator is cut at the level of the central core 12 and, for the coupler, the dielectric parts 2 and 3 as well as the metal parts 5 and 6 have been removed.

It has been mentioned that coupling is obtained by using several line elements of small length and having transverse dimensions which are small with respect to the wave length, the type and structure of these elements being different so as to provide a progressive transition, in steps, between the symmetrical or disymmetrical distribution of the fields. In this progressive transition, the isolator requires the line element the closest to it to be symmetrical. This is indeed the case of the three plate line formed by:

- the ground plane 21 of the first dielectric part 1,
- the microstrip line 20 in contact with the microstrip line 19,
- the metallization 23 of the second dielectric part 2.

The coupling device of the invention provides then the transition between an apparatus in which the field distribution is symmetrical (OSEL), and a circuit in which it is disymmetrical in four steps in which the modes are different:

- the symmetric OSEL mode, with electromagnetic surface waves, at the level of isolator 10+11+12 and its matching 7+8,
- the three plate mode at the level of the cross leg 22 of the first dielectric part 1 and of the second dielectric part 2,
- the microstrip and reactance mode at the level of the dielectric block 3 and stirrup 6,
- the disymmetric microstrip mode at the level of the eternal microstrip 9.

Keeping the width of the central core all along the transition to values very close to that of the coupling level is an essential point of the transition. The dimensions ($l_1$,$l_2$,$l_3$, $l_4$ and $h_{d3}$) of the other parts are adjusted so as to maintain the required impedance level, namely generally close to 50 ohms.

So that the coupler provides good overall matching for the isolator and its transitions, for example a standing wave ratio SWR=1.35 in a range between 6 and 18 GHz, a certain number of conditions are required. Some are of a mechanical kind:

that the thickness $h_L$ of the microstrip 9 be less than the thickness $h_F$ of the ferrite plates 10 and 11

$$h_L < h_F$$

that the thickness of $h_L$ of the microstrip 9 be equal to the thickness $h_{d1}$ and $h_{d2}$ of the dielectric parts 1 and 2

$$h_L = h_{d1} = h_{d2}$$

The others are related to the wave length $\lambda$ in a material with permittivity $\epsilon$, it being known that:

$$\lambda_\epsilon = \frac{\lambda \text{ vacuum}}{\sqrt{\epsilon}}$$

the width $l_1 = l_2$ of the three plate region (width of the dielectric parts 1 and 2) must be very much less than a quarter of the wave length in the dielectric material ($\epsilon_1$) of these parts, at the highest frequency $$l_1 = l_2 << \frac{\lambda_{\epsilon 1}}{4}$$

the length $L_1 = L_2$ of the these same parts 1 and 2 must be less than half the wave length in this same material, at the highest frequency $$L_1 = L_2 < \frac{\lambda_{\epsilon 1}}{2}$$

the width $l_3$ of the dielectric block 3 must be very much less than a quarter of the wave length in the dielectric material ($\epsilon_3$) of block 3, at the highest frequency $$l_3 << \frac{\lambda_{\epsilon 3}}{4}$$

The invention has been described with reference to the case of an OSEL isolator, and by describing and showing only a single coupling device. It is obvious to a man skilled in the art that if the symmetric device comprises more than one external connection it is provided with an adequate number of devices for coupling to an external microstrip line. For example, the isolator of FIG. 4 comprises in its construction of coupler at the end 18 of the central core and a coupler at end 19. In a variant, the second access may be equipped with a connector.

The coupling device of the invention operates at least in the frequency range 6–18 GHz, with insertion losses less than 1.6 dB and a standing wave ratio at the accesses less than 1.35.

It is applicable to all surface wave devices operating in a symmetric field distribution mode, providing that these devices have at least one microstrip type access line.

The possible variants concerning the form, nature of the materials or construction, obvious for a man skilled in the art, come within the scope of the invention, defined by the following claims.

What is claimed is:

1. A device for coupling between a symmetric electromagnetic surface wave line and an external microstrip line, the surface wave line, ending in at least one access microstrip, operating in a symmetric field distribution mode, whereas the external microstrip line operates in a disymmetric field distribution mode, said coupling device including a plurality of line elements of small lengths and with transverse dimensions small with respect to the wave length of a signal, the nature and structure of these line elements providing a progressive transition between the symmetric and disymmetric modes in four steps:

electromagnetic surface wave mode, a symmetric mode of the surface wave line, three plate mode implemented by a three plate mode line element, microstrip mode with two different dielectrics, air microstrip mode, a disymmetric microstrip mode of the external microstrip line.

2. The coupling device as claimed in claim 1, wherein the three dielectric parts forming line elements are made from polytetrafluoroethylene, charged with glass fibers for the first and second parts.

3. The coupling device as claimed in claim 1, wherein said three plate mode line element includes:

a first dielectric material part in the form of a T whose main metallized face forms the ground plane and whose other main face is metallized and etched so as to form a microstrip perpendicular to the cross leg of the T, a second dielectric material part in the form of a tongue whose main face is metallized, these two dielectric parts being each applied against a face of the access microstrip of the surface wave line, the first part so that its etched microstrip is in the axis of the access microstrip, the second part so that its metallization is perpendicular to and in contact with the access microstrip.

4. The coupling device as claimed in claim 3, wherein said first and second dielectric parts are made from a material having the same permittivity as the substrate dielectric material of the external microstrip line and has the same dielectric thickness ($h_{d1}$, $h_{d2}$) as said external line substrate ($h_L$)

$$h_{d1}=h_{d2}=h_L$$

5. The coupling device as claimed in claim 3, wherein the first dielectric part has a T shape and includes a cross leg with length $L_1$ measured perpendicularly to the access microstrip and a width $l_1$, and the second dielectric part has a length $L_2$ measured perpendicularly to the access microstrip and a width $l_2$, where $$L_1 = L_2 < \frac{\lambda_{\epsilon 1}}{2}$$

and $$l_1 = l_2 << \frac{\lambda_{\epsilon 1}}{4}$$

$\lambda_{\epsilon 1}$ being the wave length, at the maximum frequency, in the dielectric material of permittivity $\epsilon_1$.

6. The coupling device as claimed in claim 3, wherein the first and second dielectric parts are held in position and applied against the access microstrip line by means of two metal parts, made from a non magnetic material, integral with the surface wave device, the first metal part forming a support for the first dielectric part and for the access microstrip, at the same time as the ground plane of the coupling device, and the second metal part forming an element pressing the second dielectric part against the access microstrip.

7. The coupling device as claimed in claim 6, wherein the metal support has a housing for positioning the first dielectric part and the end of the external microstrip line, this latter abutting against the first dielectric part and being in contact with the end of the access microstrip.

8. The coupling device as claimed in claim 7, wherein said access microstrip is bonded to the external microstrip line by means of a conducting bonding agent.

9. The coupling device as claimed in claim 7, wherein the access microstrip is slidably movable in relation to the external microstrip line.

10. The coupling device as claimed in claim 6, wherein said microstrip mode with two different dielectrics is implemented by a line element with reactance matching, including a third dielectric material part in the form of a block laid on the end of the access microstrip between the three plate mode line element and the external microstrip.

11. The coupling device as claimed in claim 10, wherein, with $l_3$ being the length of the third dielectric part measured along the axis of the access microstrip, it is necessary for $$l_3 << \frac{\lambda_{\epsilon 3}}{2}$$

$\lambda_{\epsilon 3}$ being the wave length, at maximum frequency, in the dielectric material of permittivity $\epsilon_3$.

12. The coupling device as claimed in claim 4, wherein the three dielectric parts forming line elements are made from a ceramic material.

13. The coupling device as claimed in claim 12, wherein said ceramic material comprises alumina.

14. The coupling device as claimed in claim 10, wherein said third dielectric part is held in position by a third metal part, in the form of a stirrup made from a non magnetic material.

15. The coupling device as claimed in claim 14, wherein the permittivity of said third dielectric part, its thickness, its length and the length of the metal stirrup are adjusted for matching the discontinuity reactances.

16. The coupling device as claimed in claim 14, wherein the three metal parts are made from a metal selected from the group consisting of brass and beryllium bronze.

* * * * *